United States Patent [19]

Gierse

[11] 4,038,940

[45] Aug. 2, 1977

[54] DEVICE FOR THE APPLICATION OF MELTABLE OR LIQUID COLORS

[76] Inventor: Heinz Gierse, Taunusstrasse 33, 5 Cologne (kalk) 91, Germany

[21] Appl. No.: 598,011

[22] Filed: July 22, 1975

[30] Foreign Application Priority Data

July 24, 1974 Germany ..... 2435557

[51] Int. Cl.[2] ..... B05C 1/02

[52] U.S. Cl. ..... 118/5; 118/50; 118/202; 118/401

[58] Field of Search ..... 222/146 H; 401/189; 118/401, 50, 267, 5, 202

[56] References Cited

U.S. PATENT DOCUMENTS

| | | | |
|---|---|---|---|
| 1,019,048 | 3/1912 | James | 118/50 |
| 2,283,193 | 5/1942 | Dixon | 118/401 |
| 3,208,637 | 9/1965 | Heick | 222/146 H X |
| 3,522,836 | 8/1970 | King | 118/401 X |

*Primary Examiner*—John P. McIntosh

*Attorney, Agent, or Firm*—Dike, Bronstein, Roberts, Cushman & Pfund

[57] ABSTRACT

A marking device comprising a storage tank for holding a quantity of liquid marking material, a horn at the lower end of the tank containing a passage in communication at one end with the interior of the tank within which liquid is maintained by the head of liquid in the tank, a plurality of marking blades at the distal end of the horn with which the opposite end of the passage is in communication for delivering liquid to the blades characterized in that there is a conductor connected to the upper end of the tank for maintaining a vacuum in the tank above the liquid therein and a regulator valve for controlling the vacuum.

5 Claims, 3 Drawing Figures

DEVICE FOR THE APPLICATION OF MELTABLE OR LIQUID COLORS

The invention relates to a device for the application of melted or liquid colors, particularly of wax colors, for the coloring of cutting edges on leather goods and artificial leather goods, with a store tank for the color and a dosing aperture through which the color emerges.

Such devices are well-known and are used in the shoe and leather industry for the coloring of cutting edges or shoe soles, heels, bags, belts, straps, etc. On the known devices the melted colors are fed by a booster and circulating pump to a dosing valve, and applied to the cutting edge under a slight excess-pressure. The known devices are however complicated in construction and require for every additional color another dosing and feeding device. It further presents problems to undertake a precise adjusting as desirable for a uniform application of color.

It is the object of the present invention to create a simplified easily adjustable device for applying meltable or liquid colors which can also be equipped for several colors without any great additional expense. This task is resolved in accordance with the invention in that the store tank is tightly sealed, and connected above the color with a vacuum pump.

On the device of the invention the melted or liquid color is always on tap at the dosing aperture, which is always open during operation, without leaking as the vacuum creates a low-pressure in the store tank above the color. During operation color can at any time be withdrawn, continuously or intermittently, for application witout any further manipulation. When the work piece to be colored is drawn past the dosing aperture, then due to adhesion, color is gradually withdrawn from the store tank and applied to the work piece.

By adjusting the low-pressure in the store tank the amount of color may readily be adjusted and adapted to the viscosity of the color. This is suitably accomplished through a pressure regulating screw with fine choke bores, through which, depending on the position of the pressure regulating screw, a greater or lesser equalization of pressure is achieved between the store tank and ambient conditions. On a great low-pressure the withdrawal of color is minimal.

To assure also on meltable colors the best possible uniform color withdrawal it is advisable in development of the invention that the store tank has thermostatically controlled heating rods in the region of the colors, particularly in the proximity of the dosing aperture. Through uniform temperature and consequently uniform viscosity we obtain at the color outlet conditions which depend solely on the low pressure. Further, the color is protected against overheating.

To protect the vacuum pump against overheating it is proposed according to another development of the invention that the store tank and the vacuum pump are located in two separate parts of the housing, which are heat-insulated from one another. Hereby feeder and connecting pipes as well as the electric cable for the heating rods are advantageously installed in a joint protective piping.

A change of color may easily be accomplished if, in accordance with a further development of the invention, exchangeable color cartridges can be inserted in the store tank, which are open toward the top and have another opening in immediate proximity of the dosing aperture. For better heat transfer the color cartridge abuts closely at the heated walls of the store tank. It is also feasible that a liquid or powdery neutral contact agent fills the interspace between cartridge and walls.

The arrangement of the invention of a vacuum pump offers the additional advantage that several store tanks with different colors may be joined to one vacuum pump. Hereby the store tanks with several dosing apertures may form a part of the device. This greatly increases the capability of the device without any great constructional expenditure.

In further development of the invention the dosing aperture is formed by the interspaces of closely adjacent lamellas. The lamellas assure a uniform color distribution transverse to the sense of motion, whereby the contact with the work piece is improved by a spring mounting of the lamellas.

Basically it is possible to have all lamellas jointly spring-mounted. With an individual or groupwise spring-mounting of the lamellas, in accordance with a further development of the invention, the dosing aperture can however better adapt itself to the outline of the cutting edge or surface.

For better guidance of the work piece it is advantageous to arrange parallel to the lamellas a cover plate, which serves as guide rail for the work piece.

To prevent leaking of the liquid colors after the device has been turned off, it is proposed, in further development of the invention, that a stop cock be provided in the color ducts. The stop cock may be dispensed with on meltable colors if care is taken that thevacuum pump remains turned on until the colors have congealed. This may be accomplished in a simple manner by a thermostatic cut-out.

The drawing represents an examle of the embodiment of the invention.

Figure 1:
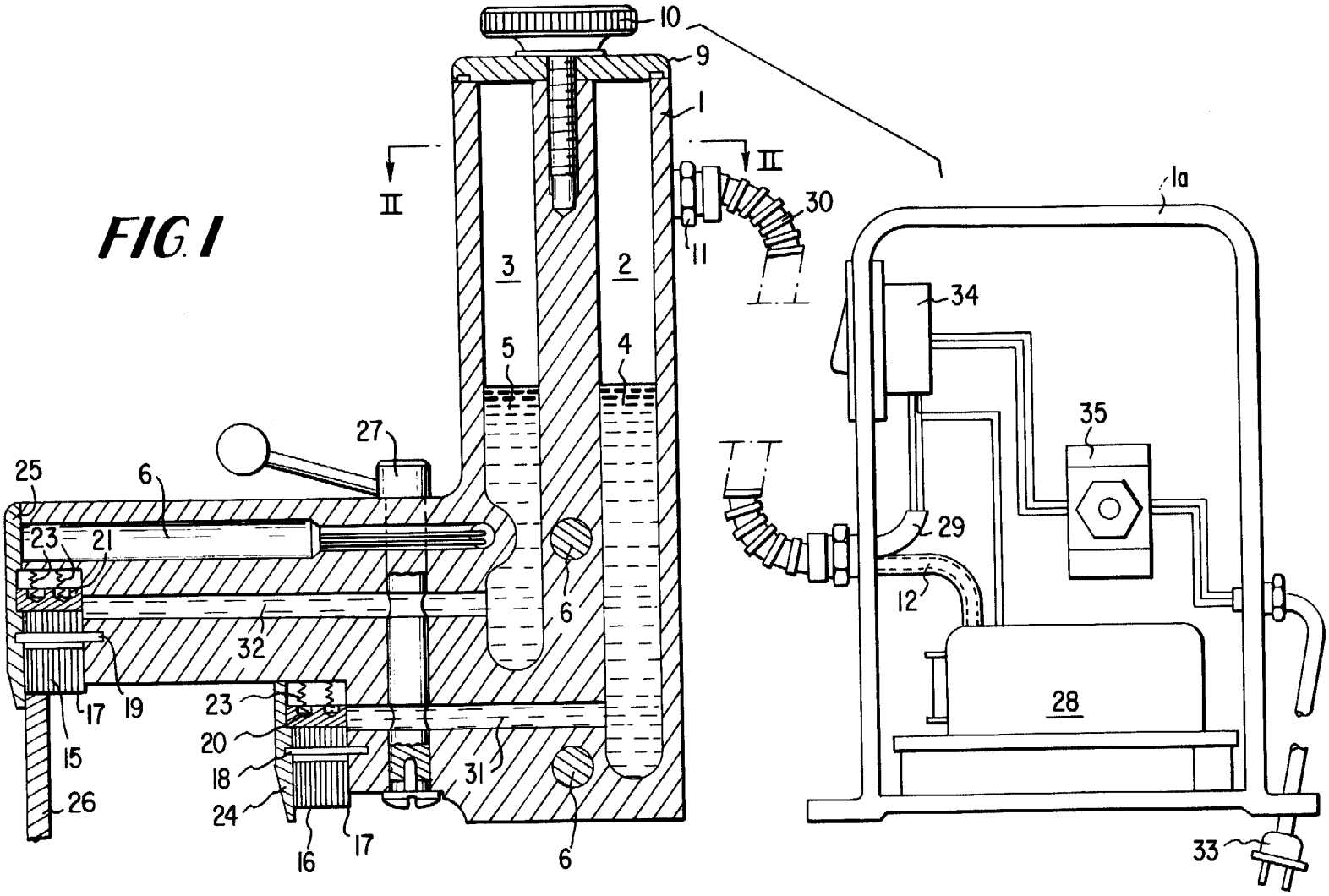
FIG. 1 shows a partial longitudinal section of a device in accordance with the invention.
Figure 3:
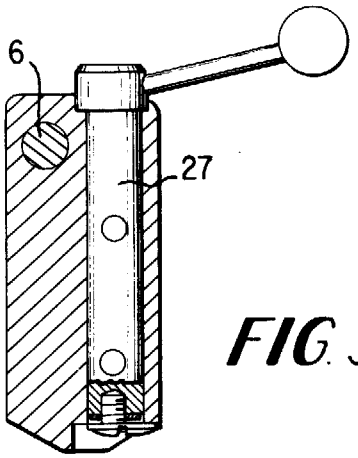
FIG. 3 shows a cross-section according to line III—III in FIG. 2.
Figure 2:
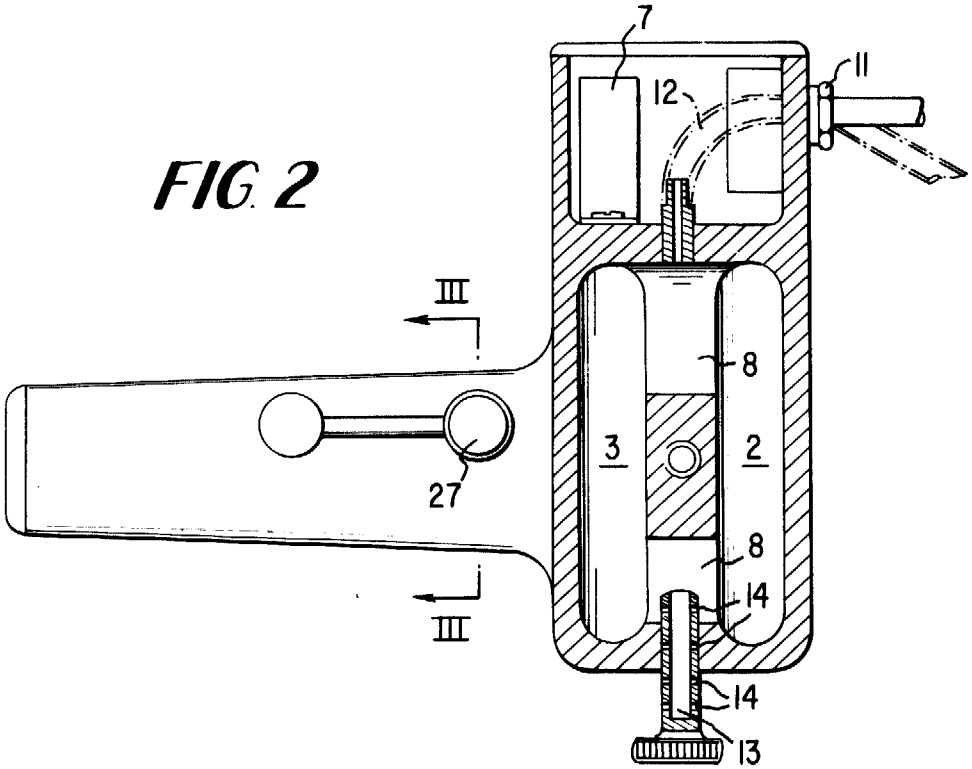
FIG. 2 shows a cross-section according to line II—II in FIG. 1.

The device consists of two housing parts 1 and 1*a*. In the housing part 1 are provided two store tanks 2 and 3 for different colors 4 and 5, which are heated and melted by heating rods 6. The heating rods 6 are regulated by a thermostat 7 in such a manner that the colors 4,5have a constant temperature. The store tanks 2,3are interconnected above the color melt through recesses 8 in the dividing wall, so that the same pressure prevails in both store tanks 2,3. Further, the store tanks 2,3 are tightly sealed by a cover 9 and central milled knob screw 10. To create a low-pressure in the store tanks 2,3above the colors 4,5there is in this region a connection 11 for a vacuum pump 28, which is housed in a heat-proof manner at some distance from the store tanks 2,3 in the housing part 1*a*. The connecting pipe 12 as well as the electric cable are enclosed in a joint protective pipe 30.

The low pressure in the store tanks 2,3 is regulated by means of a metering screw 13 with fine choke 14 or slots. In dependence on the position of the metering screw 13 there occurs a greater or lesser pressure compensation between the store tanks 2,3 and ambient conditions. With the aid of the low-pressure and the temperature control we determine the amount of color tha can be withdrawn at the dosing aperture 15,16 and applied to a work piece 26. The greater the low-pressure the smaller, at constant temperature, is the withdrawal of color.

While the device is in operation the dosing apertures 15,16 remain always open. They are formed by the inerspaces of several lamellas 17, which are suported with play on bolts 18,19 and can be brought to press on by means of contact pieces 20,21 from heat-resistant material through springs 23. It is also possible to have the lamellas 17 jointly supported individually or in groups.

The bolts 18,19 in turn are supported in housing 1 and in detachable cover plates 24,25 arranged parallel to the lamellas 17. They serve at the same time as guide rails for the work piece 26.

The device, which is especially meant for the coloring of cutting edges, may also be employed for other purposes, e.g. for the coloring of fancy lines or the like. The width of the line can hereby be determined through the number of lamellas 17. Further, in place of wax colors, also powdery synthetic colors may be used. To make it possible to stop the vacuum pump even before the colors have solidified without allowing the colors 4,5 to drip, there is provided a joint stop cock 27 in the color ducts 31,32.

The current supply, which is cut in through a switch 34, occurs through a feeder line 33. Fuses 35 are provided to protect the device.

I claim:

1. A device for applying a liquid material to the edge of a workpiece comprising a storage tank containing a chamber for holding liquid material, a horn fixed at one end to the lower end of the tank so as to extend right angularly therefrom, said horn containing a passage in communication at one end with the chamber near the bottom thereof so that the head of liquid material in the chamber maintains the passage filled with liquid material, a marking head at the distal end of the horn through which the liquid material is caused to flow onto the workpiece when the latter is presented thereto, said marking head comprising a bank of closely spaced, vertically disposed flat blades supported in said head with the planes of the blades perpendicular to the axis of the passage, with their upper ends in communication with the passage and their lower ends situated in a common plane below the passage, said bank of blades being vertically movable within the head, spring means yieldably holding the blades in the bank of blades distended, means connected to the chamber within the tank for maintaining a vacuum therein above the liquid material and a regulating valve at the top of the tank in communication with the chamber for regulating the vacuum.

2. A device according to claim 1 comprising heating elements in the horn adjacent the passage therein and thermostatic means for controlling the temperature developed by the heating means.

3. A device according to claim 1 wherein the vacuum is induced by a vacuum pump and the latter is located apart from the storage tank and connected thereto by a flexible conductor.

4. A device according to claim 1 wherein there is a guide element having a portion extending beyond the lower edges of the blades in their distended positions.

5. A device according to claim 1 wherein the storage tank has two chambers therein and the horn two passages connected, respectively, to the lower ends of the two chambers and said two chambers are connected to each other near the top such that a common vacuum is maintained in said chambers, and two marking heads supported at the lower side of the horn in axially and vertically spaced relation, said marking heads being connected, respectively, to the other ends of the passages for receiving liquid from the respective chambers.

* * * * *